US005600351A

United States Patent [19]

Holstun et al.

[11] Patent Number: 5,600,351

[45] Date of Patent: *Feb. 4, 1997

[54] INKJET PRINTER WITH INCREASED PRINT RESOLUTION IN THE CARRIAGE SCAN AXIS

[75] Inventors: Clayton L. Holstun, Escondido; Ronald A. Askeland, San Diego; Frank Drogo, San Marcos, all of Calif.; Brian P. Canfield, Barcelona, Spain

[73] Assignee: Hewlett-Packard Company, Palo Alto, Calif.

[ * ] Notice: The term of this patent shall not extend beyond the expiration date of Pat. No. 5,541,625.

[21] Appl. No.: 264,678

[22] Filed: Jun. 23, 1994

Related U.S. Application Data

[62] Division of Ser. No. 58,731, May 3, 1993, abandoned.

[51] Int. Cl.[6] ..... B41J 2/145; B41J 2/205

[52] U.S. Cl. ..... 347/40; 347/15

[58] Field of Search ..... 347/40, 5, 15, 347/43, 12, 9, 37

[56] References Cited

U.S. PATENT DOCUMENTS

| | | | |
|---|---|---|---|
| 3,404,221 | 10/1968 | Loughren | 178/5.7 |
| 5,146,236 | 9/1992 | Hirata | 347/12 |
| 5,270,728 | 12/1993 | Lund et al. | 347/5 |

FOREIGN PATENT DOCUMENTS

| | | | |
|---|---|---|---|
| A0013296 | 7/1980 | European Pat. Off. | B41J 3/04 |
| A0110494 | 6/1984 | European Pat. Off. | B41J 3/04 |
| A0518670 | 12/1992 | European Pat. Off. | B41J 2/51 |
| A0533486 | 3/1993 | European Pat. Off. | B41J 2/51 |
| 2039946 | 2/1990 | Japan | B41J 2/205 |

*Primary Examiner*—Benjamin R. Fuller
*Assistant Examiner*—Craig A. Hallacher
*Attorney, Agent, or Firm*—David S. Romney

[57] ABSTRACT

An inkjet printer system fires smaller ink droplets in a single-pass print mode to achieve addressible print resolution of 600 dpi in the carriage scan axis along with 300 dpi resolution in the media advance axis, without having to employ any dot-depletion algorithms. In one embodiment, the system provides a fast print mode which prints the smaller drops of ink on a 300 dpi grid in the carriage scan axis. In another embodiment, the system provides a single-pass color print mode wherein primary colors are printed with two color droplets of the same primary color in two adjacent sub-pixels on the 300×600 grid, and secondary colors are printed with two color droplets of different primary colors in two adjacent sub-pixels on the 300×600 grid.

20 Claims, 6 Drawing Sheets

TOP VIEW OF PRINT CARTRIDGES

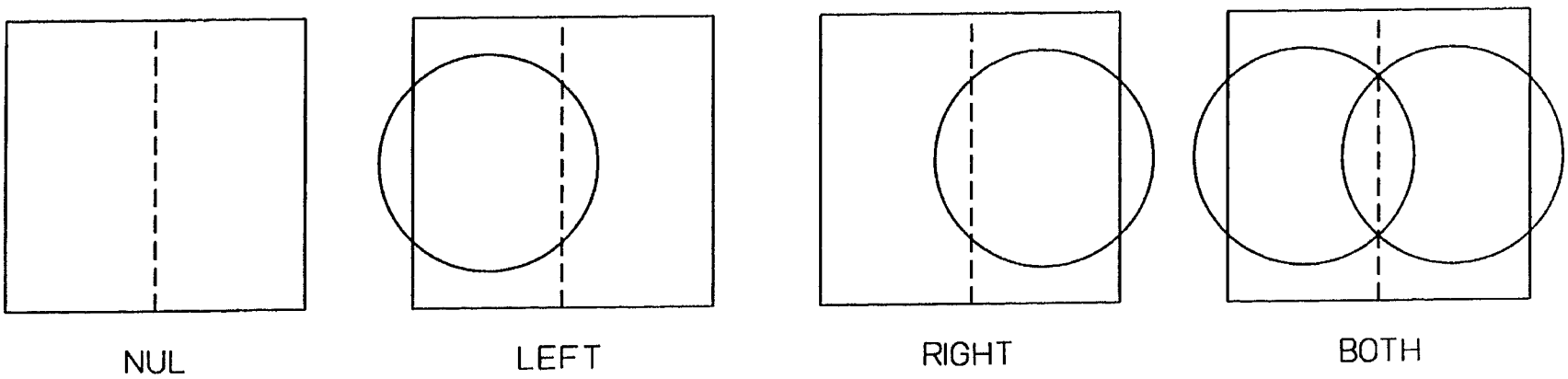
FIG. 5A
FIG. 5B
FIG. 5C
FIG. 5D
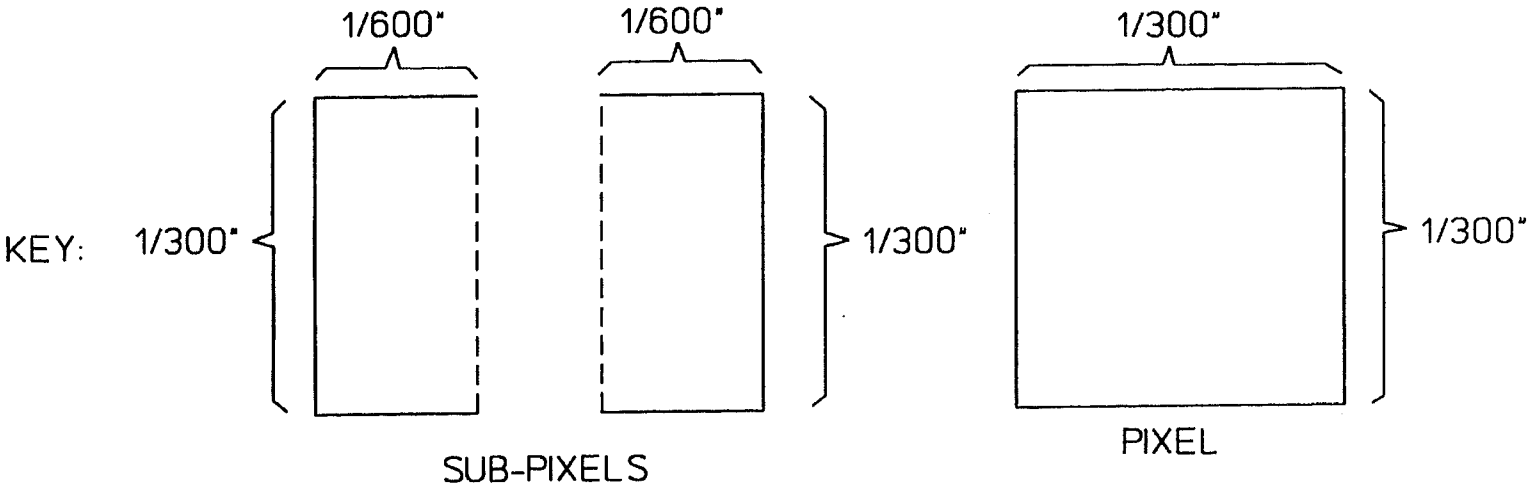
FIG. 5E
FIG. 5F

INKJET PRINTER WITH INCREASED PRINT RESOLUTION IN THE CARRIAGE SCAN AXIS

RELATED APPLICATIONS

This is a division of parent application Ser. No. 08/058,731, filed on May 3, 1993, now abandoned.

BACKGROUND OF THE INVENTION

This invention relates generally to inkjet printing, and more specifically to techniques for improving print resolution in inkjet printing.

Print resolution in inkjet printing in the media advance axis is primarily determined by the spacing of the ink orifices, and in normal circumstances the print resolution in the carriage scan axis is the same as in the media advance axis. For example, in the PaintJet and PaintJet XL printers of Hewlett-Packard Company, the print cartridges had a nozzle spacing of 1/180th of an inch thereby creating a printing resolution of 180 dots-per-inch (dpi) in the media advance axis, and the print resolution in the carriage scan axis was also 180 dpi. This symmetry made mapping of textual and graphical files for printing a relatively straightforward task.

However, even though higher resolution inkjet printheads have been developing having a nozzle spacing of 1/300th of an inch as well as 1/360th of an inch, the demand for higher quality printing is still not satisfied, and the need exists for improving the overall print resolution without having to decrease the nozzle spacing on the printhead.

BRIEF SUMMARY OF THE INVENTION

It is an object of the present invention to develop techniques for improving overall print resolution by increasing the print resolution in the carriage scan axis.

Another object is to provide an improved thermal inkjet printhead that delivers ink in smaller drop volumes and which operates at reduced firing energy levels.

A further object is to provide addressable high resolution pixels which are capable of being printed in a single pass of the print cartridge.

Another object is to provide printing resolution in the carriage scan axis which is higher than the printing resolution in the media advance axis, while at the same time minimizing the amount of ink applied to the printing media.

Thus, the invention contemplates an ink cartridge which fires smaller drops of ink onto various types of media such that two droplets can be fired onto each square pixel area in a single pass from the same cartridge to substantially fill such square pixel area. In a preferred embodiment of the invention, addressable print resolution of 600 dpi is achieved in the carriage scan axis along with 300 dpi resolution in the media advance axis, without having to employ any dot-depletion algorithms. In that regard, previous high density printing systems have typically required the use of such dot-depletion algorithms.

One embodiment incorporating the invention is a fast single pass print mode which prints the smaller drops of ink on a 300 dpi grid in the carriage scan axis.

Another important implementation of the invention relates to color print modes which achieve uniform ink distribution for both primary and second colors. In one embodiment, a single pass color print mode prints primary colors by placing two primary color droplets in two adjacent sub-pixels (300×600) and prints secondary colors by placing two different primary color droplets in two adjacent sub-pixels. In another embodiment, a two pass color print mode completes the secondary color by adding the second different primary color droplet in the return pass.

BRIEF DESCRIPTION OF THE DRAWINGS

FIGS. 5A, 5B, 5C, 5D, 5E and 5F show the various choices of sub-pixel printing in the exemplary 300×600 print resolution grid of the present invention.

DETAILED DESCRIPTION OF PREFERRED EMBODIMENTS

Figure 1:
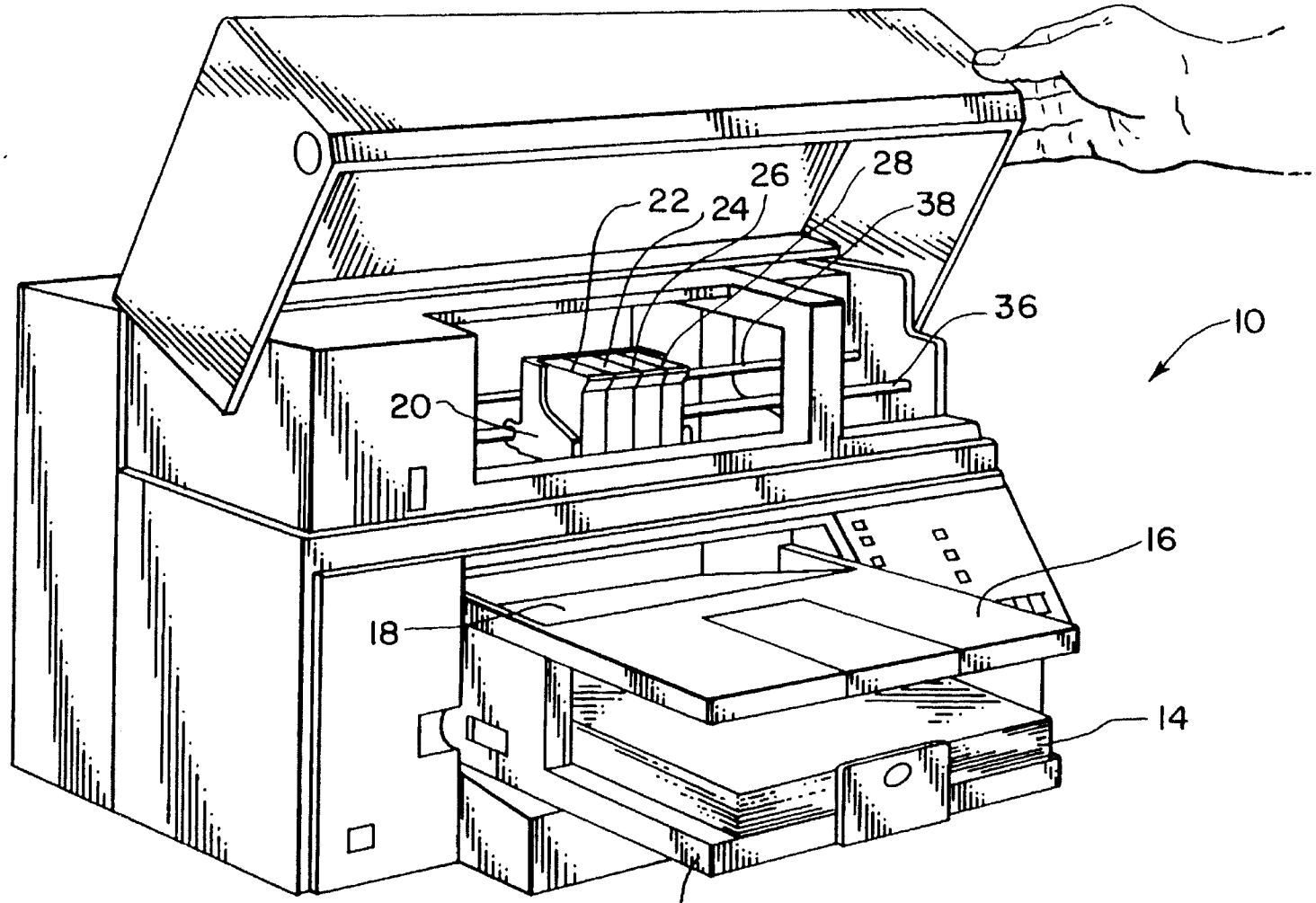
FIG. 1 is a perspective view of an exemplary color inkjet printer which may incorporate the features of the present invention.
Figure 2:
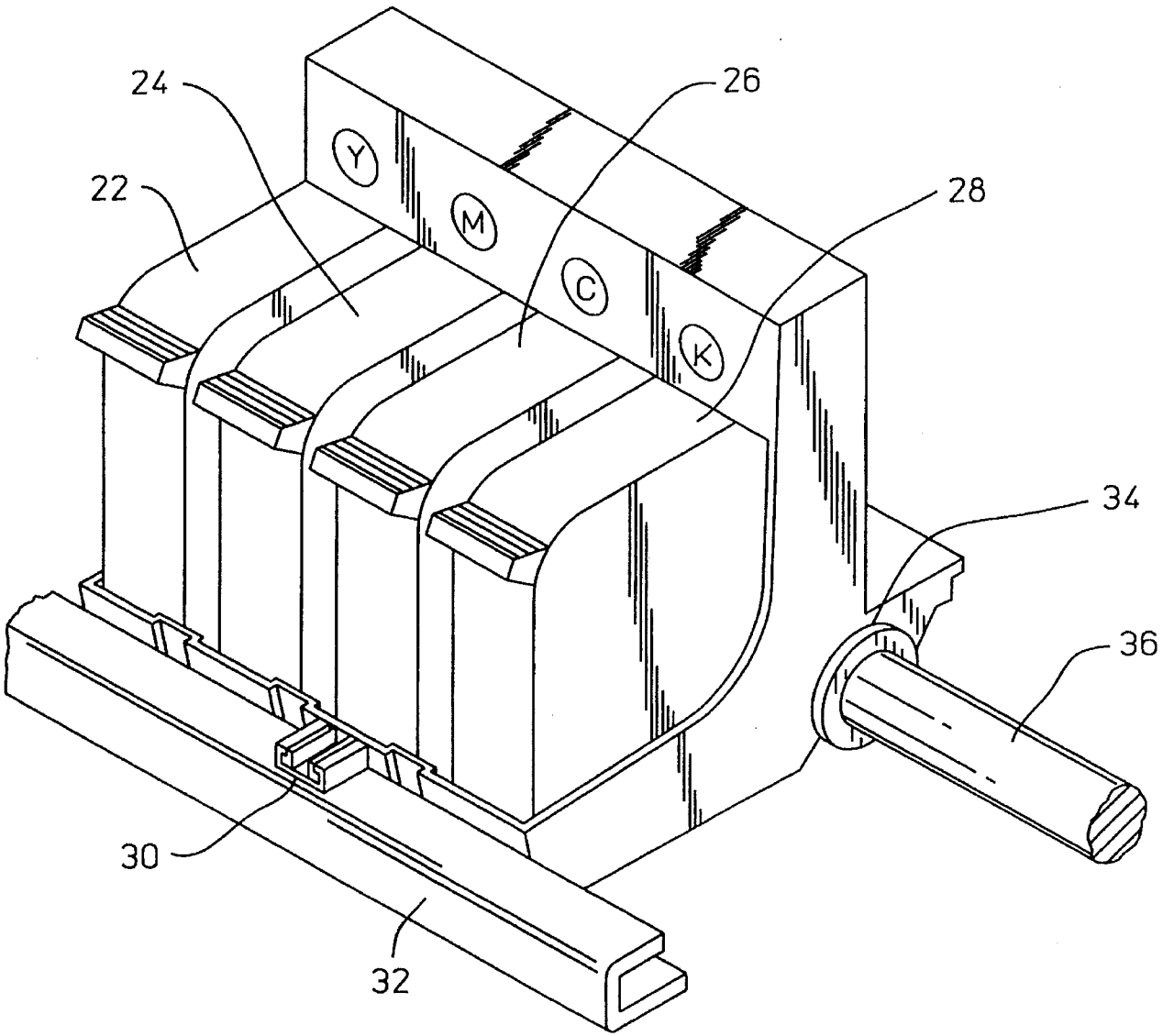
FIG. 2 is a close-up view of the carriage used in the printer of FIG. 1, showing four print cartridges each having a different color ink.

Even though the invention can be used in any printing environment where liquid ink is applied to media by a swath printer, the presently preferred embodiments of the invention are used in an inkjet printer of the type shown in FIG. 1. In particular, inkjet printer 10 includes an input tray 12 containing sheets of media 14 which pass through a print zone, and are slowly fed past an exit 18 into an output tray 16. Referring to FIGS. 1–2, a movable carriage 20 holds print cartridges 22, 24, 26 and 28 which respectively hold yellow (Y), magenta (M), cyan (C) and black (K) inks. The front of the carriage has a support bumper 30 which rides along a guide 32 while the back of the carriage has multiple bushings such as 34 which ride along slide rod 36. The position of the carriage as it traverses the media back and forth is determined from an encoder strip 38 in order to be sure that the various ink nozzles on each print cartridge are selectively fired at the appropriate time during a carriage scan.

Figure 3:
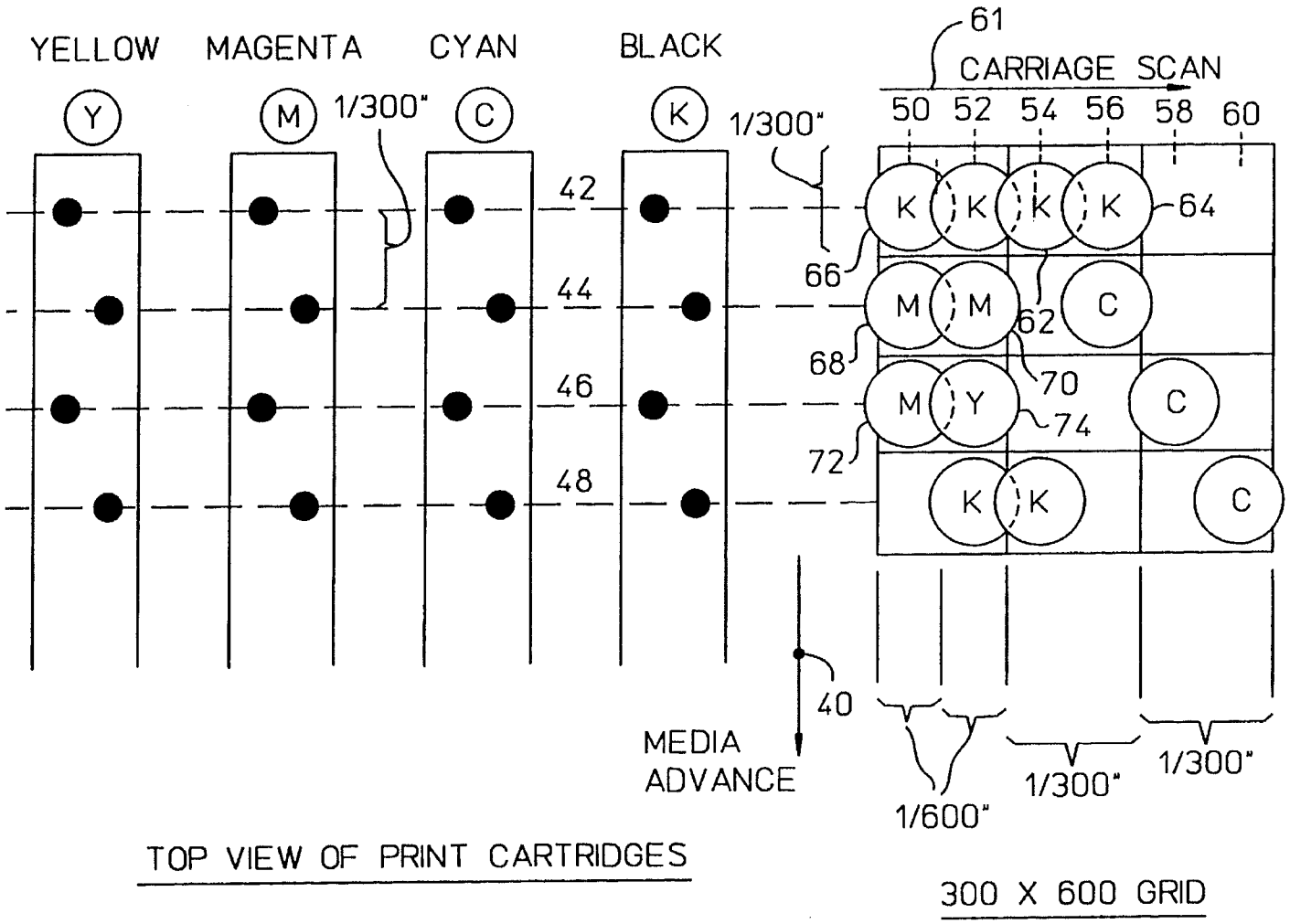
FIG. 3 is a schematic drawing showing how the print cartridges of FIG. 2 are used to fire small ink droplets in various exemplary patterns onto a 300×600 addressable grid.

The details of the unique pixel arrangement and ink droplet distribution are best shown in FIG. 3. Although the resolution achieved in such an illustrated embodiment is 300×600 dpi based on a grid having sub-pixels of 1/300th inch by 1/600th inch, the invention is not limited to any particular resolution but can be applied to any addressable pixel grid which increases the resolution in the carriage scan axis. The invention can be used to double the existing resolution (e.g. 360×720; 600×1200) or to provide a less dramatic increase in resolution (e.g., 300×450) for various print densities, all within the spirit and scope of the invention.

As shown in FIG. 3, each print cartridge employs an array of nozzles which are 1/300th of an inch apart in the direction of the media advance axis 40, and thus the center of each nozzle respectively defines the centerlines 42, 44, 46, 48 for each pixel with respect to the media advance axis. In contrast, the middle lines 50, 52, 54, 56, 58, 60 for each pixel with respect to the carriage scan axis 61 are 1/600th of an inch apart, thus providing a non-symmetrical sub-pixel which is only half as wide in one direction 63 as it is in the other direction 65 (see FIGS. 5A, 5B, 5C and 5D).

The ink droplet size is of critical importance to the present invention, and must be as small as possible and yet sufficiently large so that two drops are sufficient to completely fill a 1/300th ×1/300th inch area. Thus, the use of small drops on a 1/300th×1/600th inch sub-pixel provides improved clarity in graphic illustrations as compared to conventional resolution provided by prior art swath printers using liquid ink. In that regard, the droplet size for a normal 300 dpi pixel in a previous Deskjet inkjet print of Hewlett-Packard was approximately 135–140 picoliters, while the droplet size for an improved printer/cartridge system employing the present invention is approximately 77 picoliters. Thus the present invention achieves the desirable increased resolution without creating extreme problems of paper cockle, color bleed, long drying time, and the like that are typically associated with excessive ink on the media (e.g., high density graphics, area fills, etc.).

One characteristic of the invention is the feature of placing adjacent ink droplets on the 300×600 grid such that greater droplet overlap occurs in the carriage scan direction than in the media advance axis. In that regard, it was discovered that when the ink droplets were excessively small, horizontal banding/white space resulted, thus decreasing the print quality.

The beneficial results that occur when using this invention to print secondary colors is very evident from FIG. 3. In past inkjet printing systems, such as the 180 dpi PaintJet and PaintJet XL printers of Hewlett-Packard as well as the 300 dpi PaintJet XL300 of Hewlett-Packard, primary colors C M Y used one ink drop per standard pixel and two ink drops per standard pixel for secondary colors red (R), blue (B) and green (G), This caused problems because the secondary color pixels would have twice as much ink as the primary color pixels, and therefore display different behavior for cockle and dry time. In contrast, the present invention can employ two small drops 68, 70 per standard pixel for a primary color e.g. magenta and two small drops 72, 74 (i.e., one magenta and one yellow) per standard pixel for a secondary color e.g. red, thereby providing much better ink uniformity across media printed with color graphics. In one color print mode embodiment of the invention, secondary colors are achieved in the present invention by printing different primary colors in a single pass on immediately adjacent sub-pixels: horizontally adjacent sub-pixels in the carriage scan axis as for example 72, 74, and vertically adjacent sub-pixels in the media advance axis as for example 70, 74. In another color print mode embodiment of the invention, secondary colors are made by applying one of the different primary colors in a return pass (two pass mode) to combine with the other primary color applied on the first pass. Both color print modes of the invention provide the uniformity of ink lacking in past color systems—namely, the present invention uses two droplets per standard pixel for a primary color as well as two droplets per standard pixel for a secondary color.

Figure 4:
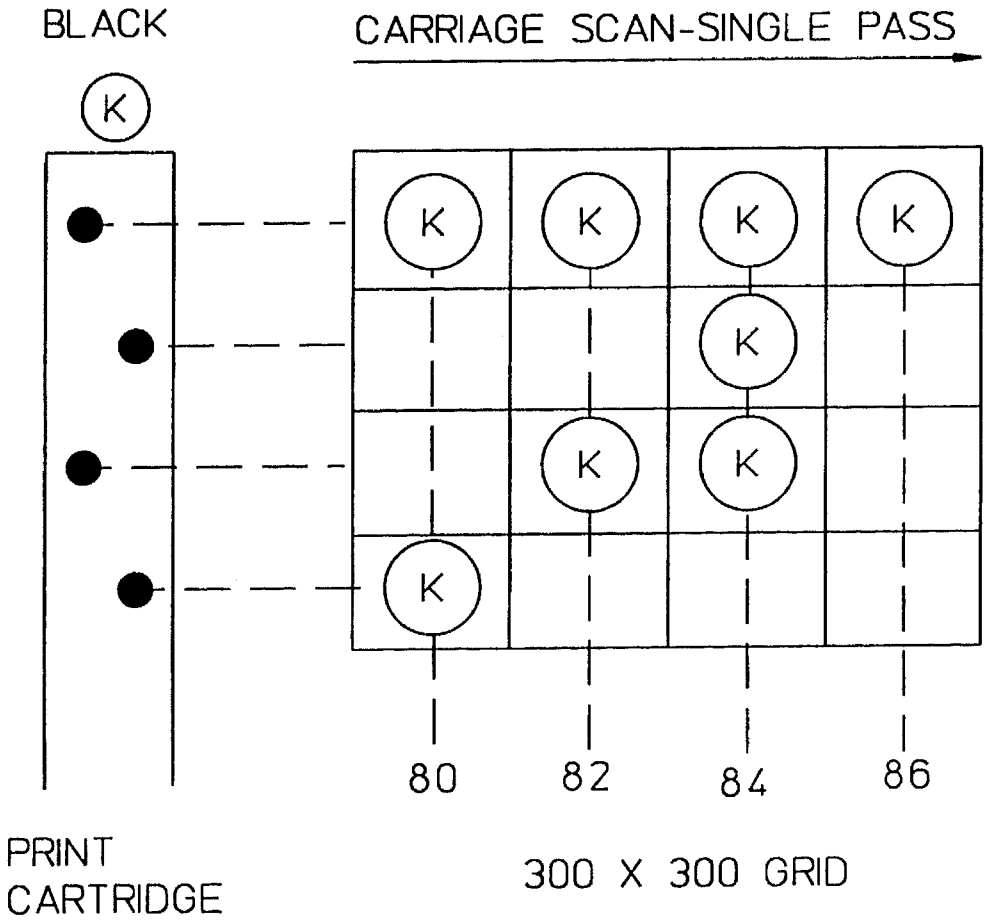
FIG. 4 is a schematic drawing showing how a single print cartridge is used in a fast draft mode to fire small ink droplets onto a 300×300 addressable grid during a single pass of the carriage.

One important benefit of the smaller ink droplet size is the increased throughput of the printer/cartridge. The firing frequency for one implementation of the present invention which uses higher viscosity ink and lower energy supplied to the ink firing resistors is 8 kHz, which is much faster than the previous 5 kHz firing frequency of 300 dpi inkjet pens used in the DeskJet printers of Hewlett-Packard. This high firing frequency is used to especially good advantage in a fast 300×300 resolution draft mode in which the carriage scan speed is doubled without changing the firing frequency of e.g. 8 kHz. Thus, as shown in FIG. 4, the center lines for the pixels in the media advance axis are on 1/300th inch centers but the small droplet size combined with the high firing (e.g. 8 kHz) frequency is believed to be unique. In that regard, data are typically received in 300 dpi resolution, and prior art fast draft modes such as the 300×150 draft mode of Hewlett-Packard's DeskJet provided lower quality printouts particularly around the edges, so it is also believed to be unique to have the same resolution (300 dpi) in the fast draft mode as for the data received by the printer, thereby maintaining overall print quality to be the same level at the edges as well as elsewhere in the image printout on the media.

It will thus be appreciated by those skilled in the art that the pixel addressability schemes of FIGS. 5A, 5B, 5C and 5D can provide unique monochrome and color print modes which take advantage of the smaller ink droplets in conjunction with the 300×600 sub-pixel grid.

Figure 6B:
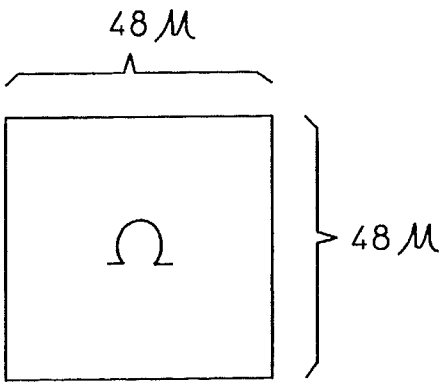
FIGS. 6A and 6B schematically show exemplary low energy circuit elements used to implement the invention in a thermal inkjet print cartridge.
Figure 6A:
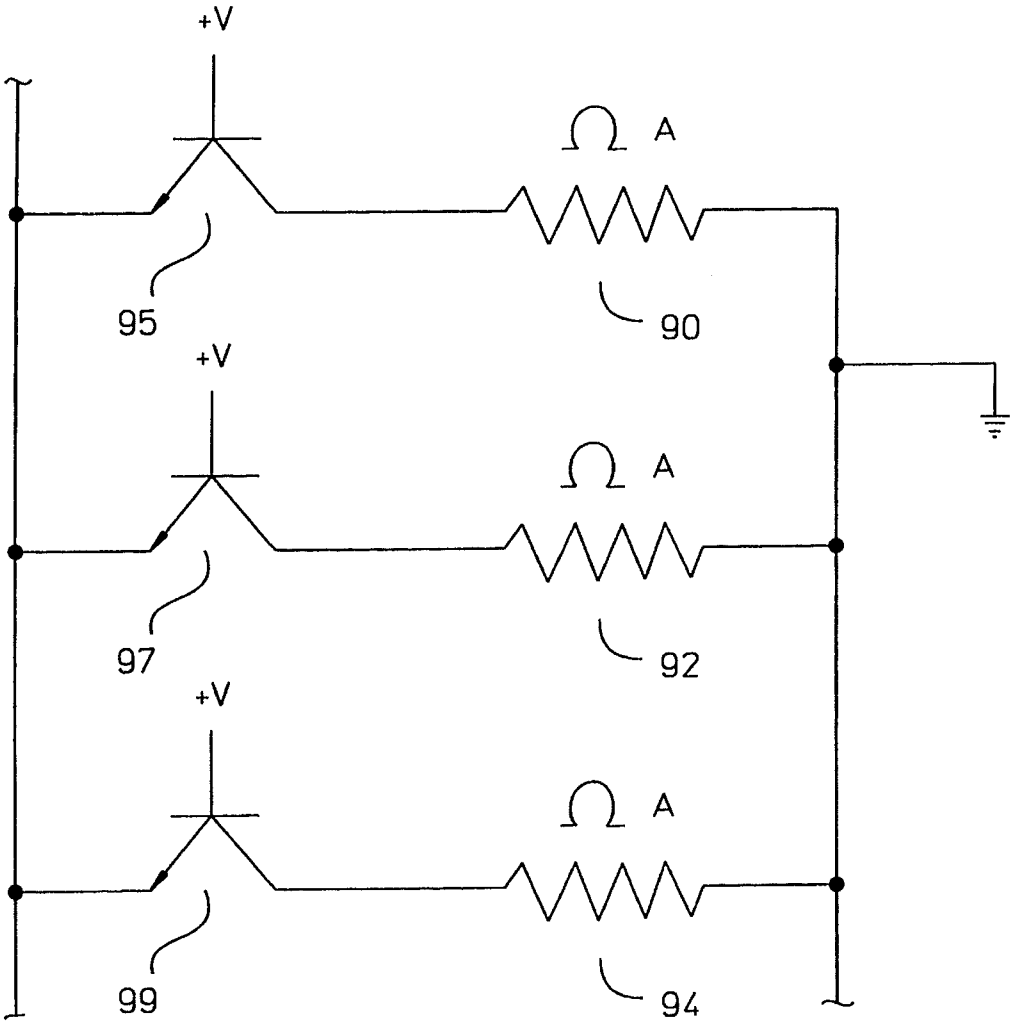

Another important feature of the invention is the use of lower energy circuitry and smaller sized firing resistors on the printhead substrate circuitry to generate the smaller ink droplets. In that regard, as shown in FIG. 6A, each of the exemplary ink firing resistors 90, 92, 94 is respectively activated with a low voltage signal of a predetermined pulse width which is selectively transmitted through transistors 95, 97, 99. Whereas prior art firing resistors for 300 dpi DeskJet print cartridges measured approximately 61 microns on each side, the resistors of a current embodiment of the present invention measure only 48 microns on each side. Whereas the energy for activating prior art firing resistors for 300 dpi DeskJet print cartridges was approximately 12 microjoules, the energy supplied to the firing resistors of a current embodiment of the present invention is only approximately 8 microjoules.

While exemplary embodiments of the invention have been shown and described, it will be understood by those skilled in the art that various changes, modification and enhancements can be made without departing from the spirit and scope of the invention as defined by the following claims.

We claim:

1. A printer having ink cartridges mounted on a carriage for applying ink to media driven in a media advance direction comprising:

a carriage movable along a carriage scan axis;

ink means for firing ink droplets from the cartridges at a predetermined firing frequency from ink nozzles having a certain spacing in the media advance direction;

wherein said carriage scans across the media to apply the droplets on an addressable grid which has a first resolution in the carriage scan axis and a second resolution in the media advance direction, said first resolution being higher than said second resolution, and said first resolution and said second resolution define standard pixels each having:

a width along the carriage scan axis equal to twice the reciprocal of the first resolution, and a height along the media advance direction equal to the reciprocal of the second resolution; and wherein said ink means fire droplets sized so that in each pass of the carriage two droplets are addressed to substantially each standard pixel.

2. The printer of claim 1 wherein said ink means applies droplets on an addressable grid wherein said first resolution X dpi in the carriage scan axis is double said second resolution Y dpi in the media advance direction.

3. The printer of claim 1, wherein:

said ink means apply droplets on sub-pixels on an addressable grid; and each sub-pixel has dimensions 1/X inch by 1/Y inch, where X is the second resolution first in the carriage scan axis and Y is the resolution in media advance direction.

4. The printer of claim 1 wherein said ink means fires two different primary color ink droplets onto immediately adjacent sub-pixels to form a secondary color.

5. The printer of claim 1 wherein said ink means apply droplets on an addressable grid without using any dot depletion.

6. An inkjet printer for applying ink droplets to a printing medium, said printer comprising:

an inkjet cartridge having a firing resistor of a predetermined size;

energy means for providing a signal to said firing resistor; and nozzle means in close proximity to said firing resistor for addressing two ink droplets onto each standard pixel measuring 1/Y inch by 1/Y inch of an addressable grid having a first printing resolution X dpi in a carriage scan direction which is higher than a second printing resolution Y dpi in a printing-medium advance axis.

7. The printer of claim 6 wherein said first printing resolution X in the carriage scan direction is twice said second printing resolution Y in the printing-medium advance axis.

8. The printer of claim 7 wherein said first printing resolution is 600 dpi and said second printing resolution is 300 dpi.

9. The printer of claim 7 which further includes first print mode means for driving the carriage at a standard scan speed to selectively apply ink droplets to each pixel in the addressable grid; and second print mode means for driving the carriage at twice the standard scan speed without changing the firing frequency of said firing resistors to selectively apply ink droplets to standard pixels of 1/Y inches on each side.

10. The printer of claim 6, wherein:

said firing resistor is generally rectangular and has sides; and the size of the resistor is less than 60 microns on each side.

11. The printer of claim 6 wherein said energy means provides a signal of energy less than 12 microjoules.

12. The printer of claim 6 wherein said nozzle means fires low-volume ink droplets capable of being fired at a firing frequency greater than 5 kHz.

13. A swath printer for applying liquid ink to media, comprising:

means for defining a pixel grid having a first standard resolution in a media advance axis and second high resolution in a carriage scan axis which is double the first standard resolution to create a hybrid pixel having a dimension X in the carriage scan axis and a dimension 2X in the media advance axis; and ink firing means for addressing ink droplets to every hybrid pixel in such a way that if two ink droplets are applied in two immediately adjacent hybrid pixels along the carriage scan axis, those two ink droplets fill most of said two hybrid pixels.

14. The printer of claim 13 which further includes ink firing means for printing primary colors by applying an ink droplet of a particular primary color to both of two adjacent hybrid pixels in the carriage scan axis and for printing secondary colors by applying an ink droplet of one specific primary color and an ink droplet of another specific primary color respectively to two adjacent hybrid pixels in the carriage scan axis.

15. A swath-type ink printer which can function at two different printing resolutions without any need for dot depletion, comprising:

means for defining a hybrid pixel grid with first pixel centerlines in a media advance axis which are spaced apart a predetermined distance A and with second pixel centerlines in a carriage scan axis which are spaced apart a distance A/2; and means for driving a carriage at a given scan speed S in a print mode to selectively address ink droplets to substantially all pixels in the hybrid pixel grid.

16. The printer of claim 15 which further includes means for driving the carriage at a scan speed of 2S in a second print mode, without changing a firing frequency of the ink droplets, to selectively apply ink droplets in the hybrid pixel grid.

17. The printer of claim 16 wherein ink droplets are applied only to every other hybrid pixel in a single scan of the carriage.

18. The printer of claim 15 wherein ink droplets are applied to adjacent hybrid pixels in a single scan of the carriage.

19. The printer of claim 15 Which further includes firing means for applying ink droplets of less than 130 picoliters.

20. The printer of claim 15 which further includes firing means for applying ink droplets of less than 100 picoliters.

* * * * *